US007725059B2

(12) United States Patent
Hirose

(10) Patent No.: US 7,725,059 B2
(45) Date of Patent: May 25, 2010

(54) IMAGE DEVELOPER PROVIDING IMPROVED DEVELOPER DISPERSIBILITY AND IMAGE FORMING APPARATUS CONTAINING THE SAME

(75) Inventor: Hiroya Hirose, Sagamiwara (JP)

(73) Assignee: Ricoh Company Limited, Tokyo (JP)

( * ) Notice: Subject to any disclaimer, the term of this patent is extended or adjusted under 35 U.S.C. 154(b) by 139 days.

(21) Appl. No.: 12/015,803

(22) Filed: Jan. 17, 2008

(65) Prior Publication Data

US 2008/0205938 A1 Aug. 28, 2008

(30) Foreign Application Priority Data

Feb. 22, 2007 (JP) ..... 2007-041737

(51) Int. Cl.
*G03G 15/08* (2006.01)

(52) U.S. Cl. ..... 399/254

(58) Field of Classification Search ..... 399/254, 399/255, 256

See application file for complete search history.

(56) References Cited

U.S. PATENT DOCUMENTS

| | | | | |
|---|---|---|---|---|
| 7,110,696 | B2 | 9/2006 | Murakami et al. | |
| 7,272,354 | B2 | 9/2007 | Murakami et al. | |
| 2005/0025518 | A1 | 2/2005 | Saito | |
| 2006/0115286 | A1* | 6/2006 | Uchitani et al. | 399/50 |
| 2007/0025773 | A1* | 2/2007 | Tateyama et al. | 399/254 |
| 2007/0160392 | A1 | 7/2007 | Tsuda et al. | |
| 2007/0189808 | A1* | 8/2007 | Kato et al. | 399/227 |
| 2007/0264052 | A1 | 11/2007 | Yoshida et al. | |
| 2007/0264054 | A1 | 11/2007 | Tsuda et al. | |
| 2007/0269235 | A1 | 11/2007 | Hirose | |
| 2008/0025761 | A1* | 1/2008 | Yoshida | 399/254 |

FOREIGN PATENT DOCUMENTS

| | | | |
|---|---|---|---|
| EP | 1 293 839 | A2 | 3/2003 |
| EP | 1 293 839 | A3 | 3/2003 |
| JP | 04168457 | A * | 6/1992 |
| JP | 5-333691 | | 12/1993 |
| JP | 11-167260 | | 6/1999 |
| JP | 11231625 | A * | 8/1999 |
| JP | 2002-251070 | | 9/2002 |
| JP | 2003-263012 | | 9/2003 |
| JP | 2003-307924 | | 10/2003 |
| JP | 2007-207281 | | 8/2007 |

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

An image developer, including a developer bearer rotatable facing an electrostatic latent image bearer; a developer feeder feeding a developer including a toner to the developer bearer; a developer collector collecting the developer separated and left from the developer bearer after the developer is fed to the electrostatic latent image bearer; a detour route including a developer stirrer and transfer stirring and transferring the developer between the developer feeder and the developer collector; a first opening connecting the developer feeder with the detour route; a second opening connecting the detour route with the developer collector; a developer supplier supplying the developer to the image developer; and a third opening connecting to the developer supplier, wherein the toner has a volume-average particle diameter of from 3 to 8 μm and a ratio (Dv/Dn) of the volume-average particle diameter (Dv) to a number-average particle diameter (Dn) thereof of from 1.00 to 1.40.

15 Claims, 6 Drawing Sheets

IMAGE DEVELOPER PROVIDING IMPROVED DEVELOPER DISPERSIBILITY AND IMAGE FORMING APPARATUS CONTAINING THE SAME

BACKGROUND OF THE INVENTION

1. Field of the Invention

The present invention relates to image forming apparatuses, particularly to copiers, facsimiles, printers and complex machines having these functions using electrophotographic processes.

2. Discussion of the Background

Recently, stable image quality which is free from uneven image density even when high-density or full-color images having a large image area are continuously produced is demanded.

Therefore, the image developer needs to separate and collect the developer from the developer bearer (herein after referred to as a developing sleeve) after producing images having a large image area consuming a large amount of the toner, feed the toner to the developer and uniformly disperse the toner therein to resume the original toner concentration, and quickly feed the developer to the developing sleeve.

However, in a conventional image developer as shown in FIG. 7, since a part separating the developer used for the development from the developing sleeve 2 and collecting the developer to a developer feeder 11 (hereinafter referred to as a screw) is close to a part feeding the new developer to the developing sleeve, the used developer is fed to the developing sleeve 2 again without a new toner, resulting in uneven image density.

In addition, since the collected developer and the developer being fed are mixed in a same section 13, the developer is difficult to have a uniform toner concentration between upstream and downstream sides of the screw 11 in FIG. 8. The developer has less toner concentration downstream and images having uneven image density in the longitudinal direction of the developing sleeve 2 are likely to be produced.

As shown in FIGS. 5 and 6, Japanese published unexamined patent application No. 5-333691 discloses a marketed functionally-separated image developer in which a screw and a feed route having been laterally located are vertically located to separate sections of feeding and collecting the developer, i.e., the developer is separated and collected by a lower screw 5 at a section 8 and the developer is fed by an upper screw 4 at a section 7.

However, at a communicating route D where the lower screw 5 transfers the developer to the screw 4, the developer needs to be deposited and the developer is fed from the section 8 to the section 7, i.e., the used developer is directly fed to the developing sleeve 2 again, resulting in uneven image density.

In addition, only the lower and upper screws do not fully stir the developer, resulting in uneven image density and deterioration of image density. Japanese published unexamined patent application No. 11-167260 discloses an image developer as shown in FIGS. 3 and 4, further including a section 9 besides the sections 7 and 8, having a stirrer 6 mixing and dispersing the collected developer and a toner fed from T to improve uniformity of the image density.

The two screws vertically located in FIGS. 5 and 6 save space more than the conventional two screws laterally located. However, as mentioned above, the developer deposited is fed to the developing sleeve again or is not well mixed with a newly-fed toner, i.e., the developer is not fully stirred, resulting in uneven image density and deterioration of image density.

In order to solve this problem, three screws are effectively located as shown in FIG. 3. The developer needs to deposit at a stirring detour 9 apart from the developing sleeve, the low-concentration developer just after collected is not fed to thereto again. Further, the collected developer and a newly-fed toner are sufficiently stirred at the stirring detour 9, which improves uneven image density.

On the other hand, the image developer has a toner concentration sensor detecting a concentration of the developer. This is typically a sensor detecting a magnetic permeability of the developer and detects a toner concentration of a specific amount of the developer close thereto. The sensor power and the toner concentration have a linear relationship each other, and the sensor detects excess and deficiency of the toner to drive or stop a feeder of the developer.

In order to detect whether a proper amount of the toner is fed, it is necessary to detect the developer fully dispersed and mixed and a specific distance is required between a position from which the toner is fed and a position the toner concentration is detected.

However, it is impossible to reduce the toner from or add the toner to the developer therebetween even when the toner is excessively or insufficiently fed from the position from which the toner is fed. Therefore, the developer has a part having a high toner concentration and a part having a low toner concentration while stirred and transferred, resulting in uneven image density after all.

In addition, polymerization toners frequently used lately are difficult to mix and disperse in image developers due to their shapes. This is because the polymerized toner having the shape of almost a sphere and a small particle diameter takes more time to mix with a developer in the image developer than conventional pulverization toners having a large particle diameter.

The toner concentration detector typically measures the concentration of the toner in a developer fully mixed. However, when the developer insufficiently mixed is detected, excessive toner feeding is repeated, resulting in toner scattering, background fouling and uneven image density.

Because of these reasons, a need exists for an image developer and an image forming apparatus capable of improving the dispersibility of a developer even including a toner having poor mixability and dispersibility, and precisely detecting the toner concentration to prevent uneven toner concentration of the developer and uneven image density.

SUMMARY OF THE INVENTION

Accordingly, an object of the present invention is to provide an image developer capable of improving the dispersibility of a developer even including a toner having poor mixability and dispersibility, and precisely detecting the toner concentration to prevent uneven toner concentration of the developer and uneven image density.

Another object of the present invention is to provide an image forming apparatus using the image developer. These objects and other objects of the present invention, either individually or collectively, have been satisfied by the discovery of an image developer, comprising:

a developer bearer configured to be rotatable facing an electrostatic latent image bearer;

a developer feeder configured to feed a developer comprising a toner to the developer bearer;

a developer collector configured to collect the developer separated and left from the developer bearer after the developer is fed to the electrostatic latent image bearer;

a detour route configured to stir and transfer the developer between the developer feeder and the developer collector;

a first opening configured to connect the developer feeder with the detour route;

a second opening configured to connect the detour route with the developer collector;

a developer supplier configured to supply the developer to the image developer; and a third opening configured to connect to the developer supplier, wherein the toner has a volume-average particle diameter of from 3 to 8 μm and a ratio (Dv/Dn) of the volume-average particle diameter (Dv) to a number-average particle diameter (Dn) thereof of from 1.00 to 1.40.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides an image developer capable of improving the dispersibility of a developer even including a toner having poor mixability and dispersibility, and precisely detecting the toner concentration to prevent uneven toner concentration of the developer and uneven image density. More particularly, the present invention relates to an image developer, comprising:

a developer bearer configured to be rotatable facing an electrostatic latent image bearer;

a developer feeder configured to feed a developer comprising a toner to the developer bearer;

a developer collector configured to collect the developer separated and left from the developer bearer after the developer is fed to the electrostatic latent image bearer;

a detour route configured to stir and transfer the developer between the developer feeder and the developer collector;

a first opening configured to connect the developer feeder with the detour route;

a second opening configured to connect the detour route with the developer collector;

a developer supplier configured to supply the developer to the image developer; and a third opening configured to connect to the developer supplier, wherein the toner has a volume-average particle diameter of from 3 to 8 μm and a ratio (Dv/Dn) of the volume-average particle diameter (Dv) to a number-average particle diameter (Dn) thereof of from 1.00 to 1.40.

An embodiment of the present invention will be explained, referring to FIGS. 1 and 2.

Figure 1:
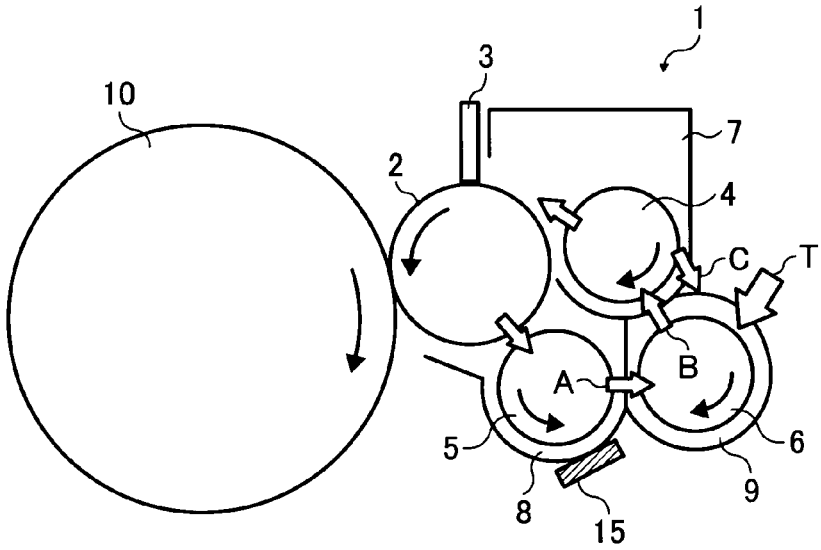
FIG. 1 is a schematic view illustrating a cross-section of the image developer of the present invention, and of a photoreceptor.

FIG. 1 is a schematic view illustrating a cross-section of the image developer of the present invention, and of a photoreceptor. First, the surface of a rotatable photoreceptor 10 is uniformly charged with a charger (not shown). Next, information based on an original read with an image reader (not shown) or information from a host PC is written thereon with a laser beam from a laser writer (not shown) to form an electrostatic latent image thereon.

An image developer 1 includes a rotatable developing sleeve 2 including a magnetic material (not shown) and uniformly feeding a toner to the photoreceptor 10 to visualize the electrostatic latent image. The magnetic material holds a developer on the developing sleeve 2, and a doctor blade 3 regulates an amount thereof to be held.

The doctor blade 3 is mostly a plate such as a stainless plate leaving from the developing sleeve 2 at a distance of 0.2 to 1.2 mm to form a uniform thin layer of the developer thereon and uniformly feed the developer to the electrostatic latent image on the photoreceptor 10 without irregularities.

The image developer 1 is filled with a developer, and a consumed developer is replaced with and a new developer in many cases. A feeder feeding a new developer and a collector separating and collecting a consumed developer are required close to the doctor blade. In order to separate a consumed developer, the magnetic material in the developing sleeve 2 is partially demagnetized.

Next, the developer movement in the image developer 1 will be explained. The feeder feeding the developer close to the developing sleeve 2 and doctor blade 3 may have the shape of a paddle capable of boosting and flipping up, and has the shape of a screw laterally transferring the developer as shown in FIG. 2 in the present invention.

The collector collecting a separated developer also may have the shape of a paddle to quickly scrape up the developer, and preferably has the shape of a screw to transfer the developer in the axial direction of the developing sleeve 2.

Figure 2:
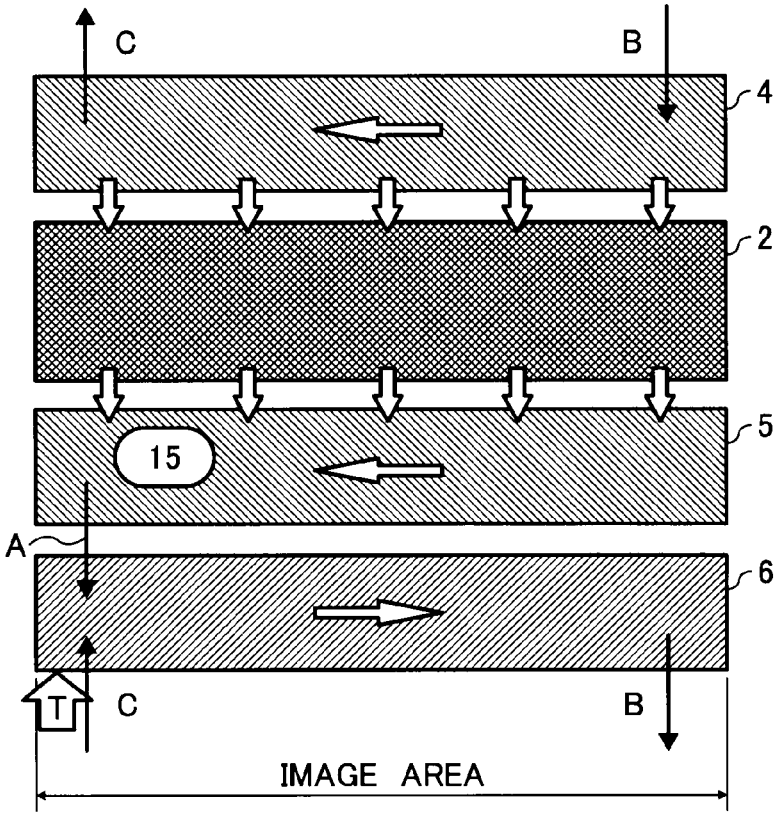
FIG. 2 is an explanatory drawing of the developer circulation of the present invention.

In FIG. 2, a developer is fed from a feeding screw 4 to the developing sleeve 2, the developer after used for developing separates and leaves therefrom and is collected by a collection screw 5 as indicated by an arrow. The developer separated and left from the developing sleeve 2 is preferably collected quickly.

Figure 7:
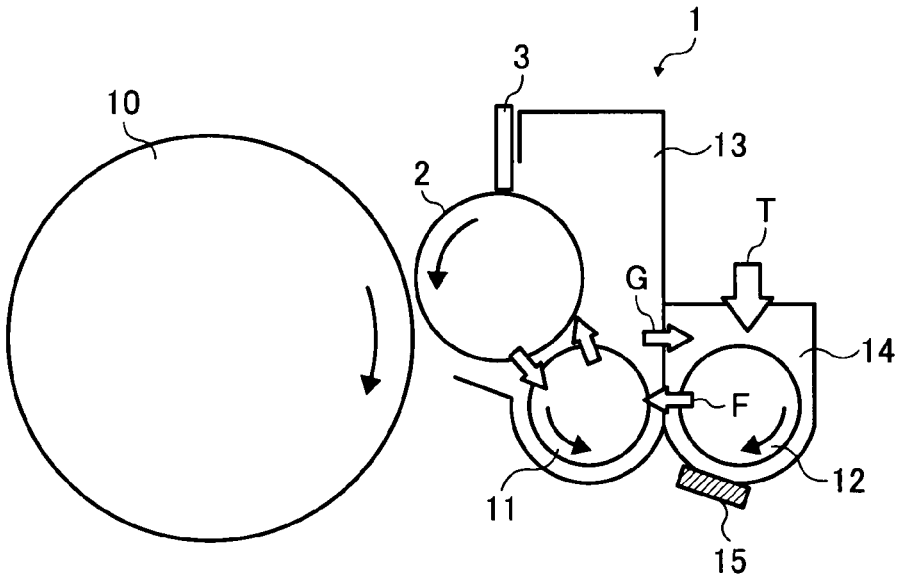
FIG. 7 is a schematic view illustrating a cross-section of a conventional image developer, and of a photoreceptor.
Figure 8:
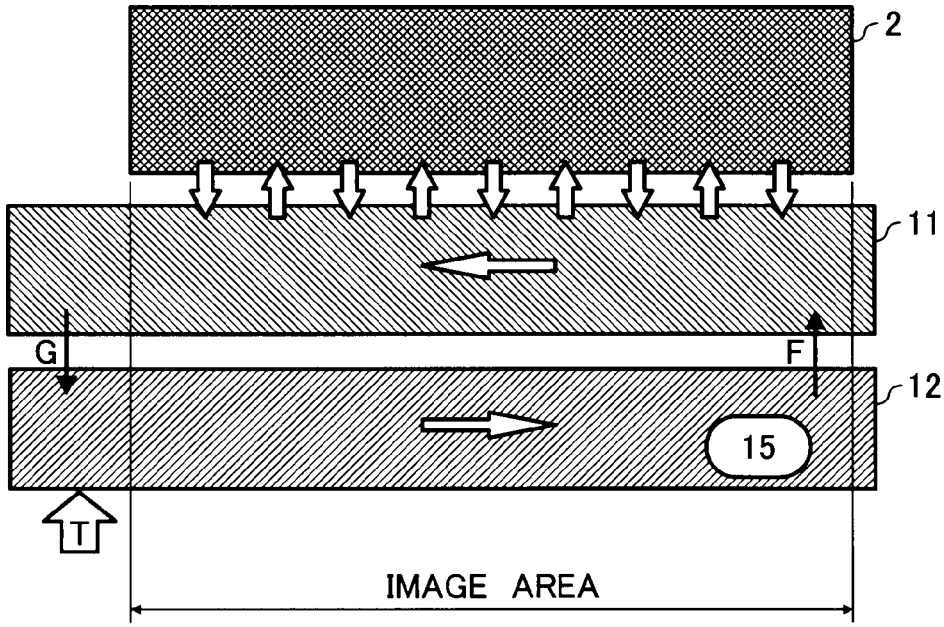
FIG. 8 is an explanatory drawing of the developer circulation in FIG. 7.

A difference with a conventional image developer is using screws independently for feeding and collecting the developer. In FIGS. 7 and 8, only a screw 11 transfers the developer to a developing sleeve 2. In FIGS. 7 and 8, an excessive developer from a first transfer (feeding) route and a collection developer from a second transfer (collection) route are united, stirred and circulated to the first transfer (feeding) route through a third transfer (stirring detour) route. The developer circulated to the first transfer (feeding) route has a more uniform concentration of the toner, and high-quality images having a constant image density without uneven image density can be produced even when having a high image area. The conventional image developer as the same structures as the present invention in respect of a first transfer (feeding) route, a second transfer (collection) route and a third transfer (stirring detour) route. Three openings located on a downstream side of the feeding route to the stirring detour, from the collection route to the stirring detour, and from the stirring detour to the feeding route respectively are same as well. However, the conventional image developer has a toner concentration detector at the third transfer (stirring detour) route, different from a downstream side of the second transfer (collection) route of the present invention.

The conventional image developer has an opening for feeding toner on a downstream side of the first transfer (feeding) route and a toner concentration sensor detects the concentration of the developer after the toner is fed to, which is largely different from detecting the concentration of the developer before the toner is fed to of the present invention.

In the image developer 1 in FIGS. 1 and 2, the feeding screw 4 and collection screw 5 are separately located to perform independent functions. A housing of the image developer is located surrounding the feeding screw 4 and has a slit-shaped opening to the doctor blade 3 and the developing sleeve 2 to form a section 7 is formed therein. Similarly, the housing is located surrounding the collection screw 5 and has a slit-shaped opening to the surface of the developing sleeve 2 to form a section 8 therein.

The developer present at the sections 7 and 8 needs replacing. The conventional image developer in FIGS. 5 and 6 has communicating openings of D and E through which the developer directly comes in and out. In order to transfer the developer from the section 8 to the section 7, the developer needs depositing at the section 8. The developer is deposited at the opening Din FIG. 6, i.e., on a lowermost downstream side of the collection screw 5 and is transferred to the feeding screw 4.

Figure 3:
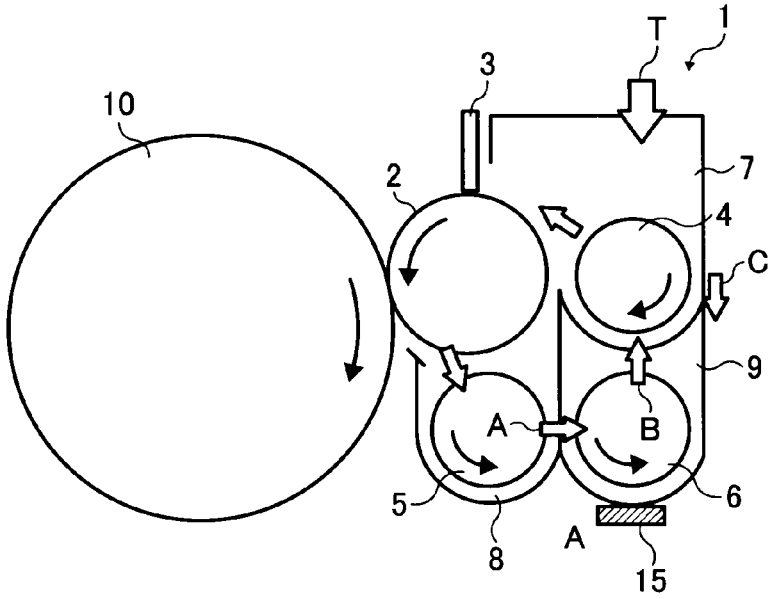
FIG. 3 is a schematic view illustrating a cross-section of a conventional image developer having a detour transfer route, and of a photoreceptor.
Figure 4:
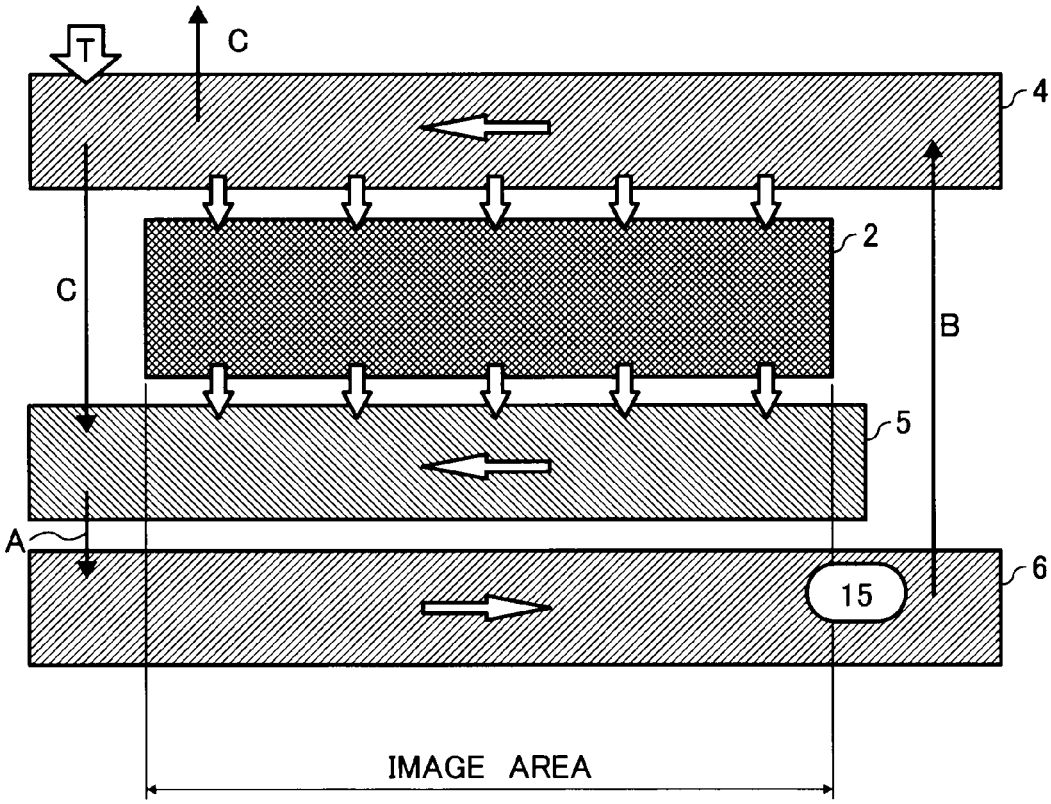
FIG. 4 is an explanatory drawing of the developer circulation in FIG. 3.
Figure 5:
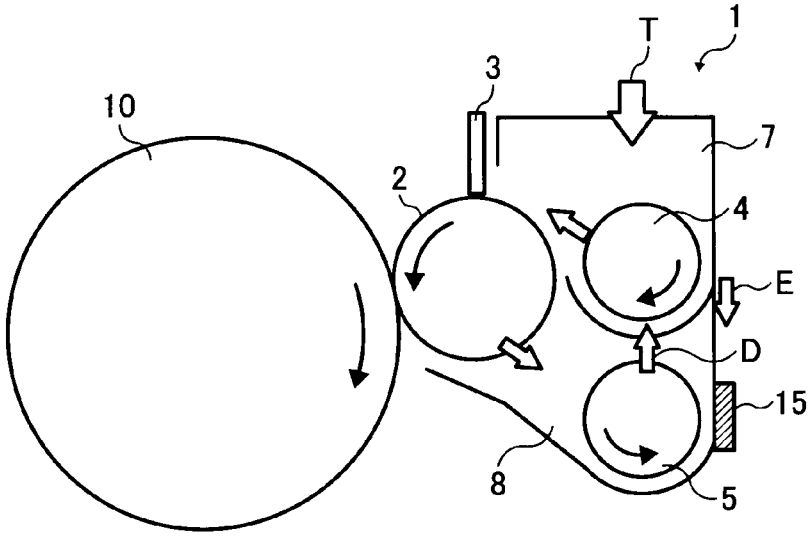
FIG. 5 is a schematic view illustrating a cross-section of a conventional image developer having vertically-located two screws, and of a photoreceptor.
Figure 6:
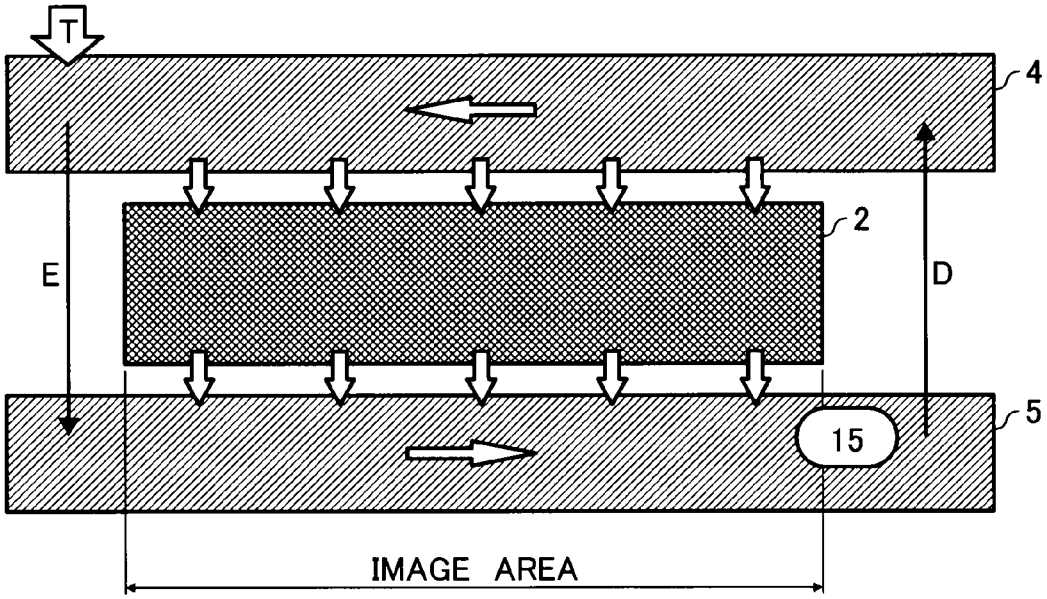
FIG. 6 is an explanatory drawing of the developer circulation in FIG. 5.

However, when the deposited developer reaches the inside of axial direction of the developing sleeve 2 shown in FIG. 6, i.e., an image area, the collection section 8 shown in FIG. 5 is filled with the developer and the developer directly enters the feeding section 7 along the surface of the developing sleeve 2 without passing the opening D. Most of the developer pass through the doctor blade, resulting in uneven image density. As shown in FIGS. 3 and 4, the detour transfer section 9 is located between the collection section 8 and the feeding section 7, in which the developer deposits to prevent the deposited developer from being fed to the developing sleeve 2 again. In FIGS. 3 and 4, a stirring screw 6 is located in the detour transfer section to lengthen a stirring distance as long as possible because of preventing uneven image density due to insufficient mixing of the toner with the collected developer. In addition, it is suggested that the stirring distance is further extended with four screws in order to improve stirring performance.

In FIGS. 3 and 4, a feeding opening T of the toner fed from a feeder (not shown) is located at the farthest reaches of an opening B just before feeding the developer to the developing sleeve, and a toner concentration sensor 15 is preferably located at the farthest reaches of the feeding opening where the developer deposits, i.e., close to the opening B where the developer is lifted up to the screw above.

This is because the toner sensor 15 is preferably located close to the opening B to detect the developer sufficiently stirred. In the present invention, as shown in FIG. 1, the toner concentration sensor 15 is located on a downstream side of the developer collection screw 5, which detects the developer before a new toner is fed thereto and an amount of the toner consumed to feed just a necessary amount thereof to the image developer through the feeding opening T. Therefore, in the present invention, the toner concentration before the toner is fed to the developer is detected, which is largely different from the conventional detection of the toner concentration after the toner is fed to the developer. It is not necessary to detect the toner concentration after the toner is fed thereto and necessary to precisely detect the toner concentration before the toner is fed thereto without delay. In addition, in the present invention, the image developer 1 includes three screws. In the conventional image developer in FIG. 7, the developer used for developing is mixed with the other developer just after separating and leaving from the developing sleeve 2. Therefore, it is impossible to detect the toner concentration before the toner is fed to the developer, and the toner feeding is controlled with the concentration thereof when the developer is mixed as above. For example, when images having a low image area, the toner is consumed less and the image density varies less. However, images having a large image area consumes the toner more and the toner concentration in the image developer 1 partially differentiates, resulting in uneven image density. Conventionally, the toner consumption is forecasted from an image area and the toner is fed to the image developer to prevent uneven image density. However, it is complicated to control feeding the toner thereby. In the image developer vertically including two screws, a toner feeding opening T is located farthest reaches of the developer feeding screw 4, i.e., a downstream side thereof as shown in FIG. 6.

However, the new developer is mixed with the collected developer, and the toner concentration of the developer before the toner is fed thereto is difficult to detect. Therefore, the toner concentration of the developer after the toner is fed thereto is detected, which is different from the present invention.

The image developer 1 using three screws will be explained. As shown in FIG. 2, the feeding screw 4 and collection screw 5 are located parallel to the developing sleeve 2, and the screws 4 and 5 transfers the developer in the axial direction of the developing sleeve 2.

The detour transfer screw 6 transfers the developer in the direction opposite to those of the feeding screw 4 and collection screw 5. On the lowermost downstream side of the detour transfer screw 6, the developer needs transferring to the feeding section 7 where the feeding screw 4 is located through an opening B while depositing in the detour transfer section 9. A space between the detour transfer screw 6 and a developer container is preferably as small as possible, i.e., the detour transfer section 9 is preferably so formed as to surround the outer circumference of the screw, which effectively transfer the deposited developer.

In the image developer including functionally-independent three screws, i.e., the feeding screw 4, the collection screw 5 and the stirring transfer screw 6, the toner concentration sensor 15 detects the toner consumption, i.e., an amount of the toner required on a downstream side of the collection screw 5 to drive a toner feeder in real time. Therefore, the developer in the stirring transfer section 9 and the stirring transfer screw 6 has a stable toner concentration.

In combination with the conventional art of the location of the toner concentration sensor, the present invention largely improves uneven image density without using the complicated forecast of the toner consumption based on the image area.

This is not only the case where the feeding screw is above the collection screw, but also the case where the collection screw is above the feeding screw.

Next, a toner preferably used in the present invention will be explained. The toner preferably has a volume-average particle diameter of from 3 to 8 μm to produce an image of 600 dpi. The toner preferably has a ratio (Dv/Dn) of the volume-average particle diameter thereof to a number-average particle diameter thereof of from 1.00 to 1.40. The closer to 1.00, the sharper the particle diameter distribution.

Although such a toner having a small particle diameter and a sharp particle diameter distribution has uniform charge quantity distribution and high transferability, and produces high-quality images with less background fouling, the toner has slightly poor mixability and dispersibility with a developer in an image developer and is likely to produce images having uneven image density.

Coulter Counter TA-II and Coulter Multisizer II from Beckman Coulter Inc. are used for measuring the particle diameter distribution as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

The toner preferably has a shape factor SF-1 of from 100 to 180, and a shape factor SF-2 of from 100 to 180.

Figure 9:
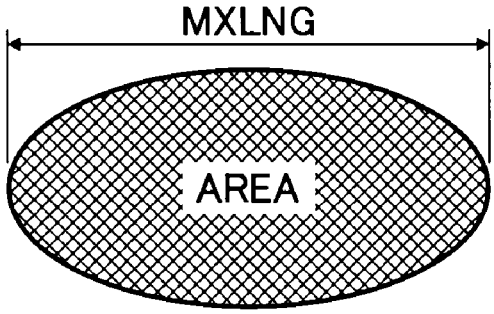
FIG. 9 is a schematic view for explaining a shape of the toner of the present invention.
Figure 10:
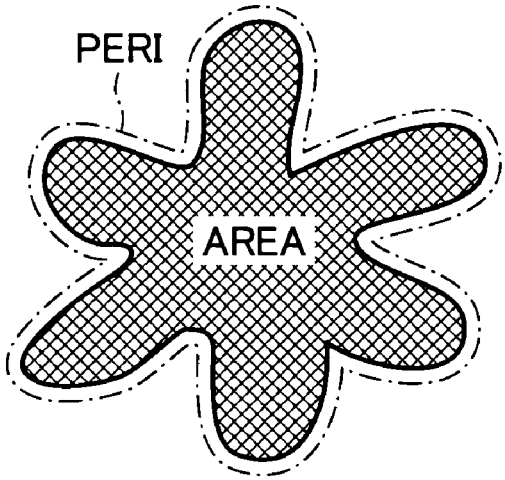
FIG. 10 is a schematic view for explaining a shape of the toner of the present invention.

FIGS. 9 and 10 are schematic views illustrating shapes of toners for explaining shape factors SF-1 and SF-2. The shape factor SF-1 represents a degree of roundness of a toner, and is determined in accordance with the following formula (1):

$$SF\text{-}1=\{(MXLNG)^2/AREA\}\times(100\pi/4) \quad (1)$$

wherein MXLNG represents an absolute maximum length of a particle and AREA represents a projected area thereof.

When the SF-1 is 100, the toner has the shape of a complete sphere. As SF-1 becomes greater, the toner becomes more amorphous.

SF-2 represents the concavity and convexity of the shape of the toner, and specifically a square of a peripheral length of an image projected on a two-dimensional flat surface (PERI) is divided by an area of the image (AREA) and multiplied by 100 π/4 to determine SF-2 as the following formula (2) shows.

$$SF\text{-}2=\{(PERI)^2/AREA\}\times(100\pi/4) \quad (2)$$

When SF-2 is 100, the surface of the toner has less concavities and convexities. As SF-2 becomes greater, the concavities and convexities thereon become more noticeable.

The shape factors are measured by photographing the toner with a scanning electron microscope (S-800) from Hitachi, Ltd. and analyzing the photographed image of the toner with an image analyzer Luzex III from NIRECO Corp.

When the shape of a toner is close to a sphere, the toner contacts the other toner or a photoreceptor at a point. Therefore, the toners adhere less each other and have higher fluidity. In addition, the toner and the photoreceptor less adhere to each other, and transferability of the toner improves. When SF-1 or SF-2 is more than 180, the transferability thereof deteriorates.

The toner preferably used for the image forming apparatus of the present invention is formed by a crosslinking and/or an elongation reaction of a toner constituent liquid including at least polyester prepolymer having a functional group including a nitrogen atom, polyester, a colorant, a charge controlling agent and a release agent are dispersed in an organic solvent in an aqueous medium. Hereinafter, the toner constituents will be explained.

The polyester is formed by polycondensating a polyol compound and a polycarboxylic compound.

As the polyol (PO), diol (DIO) and triol (TO) can be used, and the DIO alone or a mixture of the DIO and a small amount of the TO is preferably used. Specific examples of the DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide. As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid.

In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester. The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1. The polycondensation reaction between the PO and PC is performed by heating the Po and PC at from 150 to 280° C. in the presence of a known esterification catalyst such as tetrabutoxytitanate and dibutyltinoxide and removing produced water while optionally depressurizing to prepare polyester having a hydroxyl group. The polyester preferably has a hydroxyl value not less than 5, and an acid value of from 1 to 30 and more preferably from 5 to 20.

When the polyester has an acid value within the range, the resultant toner tends to be negatively charged to have good affinity with a recording paper and low-temperature fixability of the toner on the recording paper improves. However, when the acid value is greater than 30, the resultant toner is not stably charged and the stability becomes worse by environmental variations. The polyester preferably has a weight-average molecular weight of from 10,000 to 400,000, and more preferably form 20,000 to 200,000. When the weight-average molecular weight is less than 10,000, offset resistance of the resultant toner deteriorates. When greater than 400,000, low-temperature fixability thereof deteriorates. The polyester preferably includes a urea-modified polyester besides an unmodified polyester formed by the above-mentioned polycondensation reaction. The urea-modified polyester is formed by reacting a polyisocyanate compound (PIC) with a carboxyl group or a hydroxyl group at the end of the polyester formed by the above-mentioned polycondensation reaction to form a polyester prepolymer (A) having an isocyanate group, and reacting amine with the polyester prepolymer (A) to crosslink and/or elongate a molecular chain thereof.

Specific examples of the PIC include aliphatic polyisocyanate such as tetramethylenediisocyanate, hexamethylenediisocyanate and 2,6-diisocyanatemethylcaproate; alicyclicpolyisocyanate such as isophorondiisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

The polyester prepolymer (A) preferably includes a polyisocyanate group of from 0.5 to 40% by weight, more preferably from 1 to 30% by weight, and furthermore preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) reacted with the polyester prepolymer (A) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoronediamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the toner.

The urea-modified polyester may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates. The urea-modified polyester can be prepared by a method such as a one-shot method. The PO and PC are heated at from 150 to 280° C. in the presence of a known esterification catalyst such as tetrabutoxytitanate and dibutyltinoxide and removing produced water while optionally depressurizing to prepare polyester having a hydroxyl group. Next, the polyisocyanate is reacted with the polyester at from 40 to 140° C. to form a polyester prepolymer (A) having an isocyanate group. Further, the amines (B) are reacted with the (A) at from 0 to 140° C. to form a urea-modified polyester.

When the PIC, and (A) and (B) are reacted, a solvent may optionally be used. Specific examples of the solvents include inactive solvents with the PIC such as aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

A reaction terminator can optionally be used in the crosslinking and/or elongation reaction between the (A) and (B) to control a molecular weight of the resultant urea-modified polyester. Specific examples of the reaction terminators include monoamines such as diethylamine, dibutylamine, butylamine and laurylamine; and their blocked compounds such as ketimine compounds.

The weight-average molecular weight of the urea-modified polyester is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester is not particularly limited when the aftermentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

A combination of the urea-modified polyester and the unmodified polyester improves low temperature fixability of the resultant toner and glossiness of color images produced thereby, and is more preferably used than using the urea-modified polyester alone. Further, the unmodified polyester may include modified polyester except for the urea-modified polyester.

It is preferable that the urea-modified polyester at least partially mixes with the unmodified polyester to improve the low temperature fixability and hot offset resistance of the resultant toner. Therefore, the urea-modified polyester preferably has a structure similar to that of the unmodified polyester.

A mixing ratio between the unmodified polyester and urea-modified polyester is from 20/80 to 95/5, preferably from 70/30 to 95/5, more preferably from 75/25 to 95/5, and even more preferably from 80/20 to 93/7. When the urea-modified polyester is less than 5%, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45 to 65° C., and preferably from 45 to 60° C. When the glass transition temperature is less than 45° C., the high temperature preservability of the toner deteriorates. When higher than 65° C., the low temperature fixability deteriorates.

As the urea-modified polyester is likely to be present on a surface of the parent toner, the resultant toner has better heat resistance preservability than known polyester toners even though the glass transition temperature of the urea-modified polyester is low.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight.

The colorant for use in the present invention can be used as a masterbacth pigment when combined with a resin. Specific examples of the resin for use in the masterbacth pigment or for use in combination with masterbacth pigment include the modified and unmodified polyester resins mentioned above; styrene polymers and substituted styrene polymers such as polystyrene, poly-p-chlorostyrene and polyvinyltoluene; or their copolymers with vinyl compounds; polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

A wax for use in the toner of the present invention as a release agent has a low melting point of from 50 to 120° C. When such a wax is included in the toner, the wax is dispersed in the binder resin and serves as a release agent at a location between a fixing roller and the toner particles. Thereby, hot offset resistance can be improved without applying an oil to the fixing roller used. Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropschwaxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used. These charge controlling agent and release agents can be dissolved and dispersed after kneaded upon application of heat together with a master batch pigment and a binder resin, and can be added when directly dissolved or dispersed in an organic solvent.

The toner particles are preferably mixed with an external additive to assist in improving the fluidity, developing property and charging ability of the toner particles. Suitable external additives include inorganic particulate materials. It is preferable for the inorganic particulate materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition. Specific examples of such inorganic particulate materials include silica, alumina, titanium oxide, barium titanate, magnesium titanate, calcium titanate, strontium titanate, zincoxide, tinoxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Among these particulate inorganic materials, a combination of a hydrophobic silica and a hydrophobic titanium oxide is preferably used. In particular, when a hydrophobic silica and a hydrophobic titanium oxide each having an average particle diameter not greater than 50 nm are used as an external additive, the electrostatic force and van der Waals' force between the external additive and the toner particles are improved, and thereby the resultant toner composition has a proper charge quantity. In addition, even when the toner composition is agitated in a developing device, the external additive is hardly released from the toner particles, and thereby image defects such as white spots and image omissions are hardly produced. Further, the quantity of particles of the toner composition remaining on image bearing members can be reduced.

When particulate titanium oxides are used as an external additive, the resultant toner composition can stably produce toner images having a proper image density even when environmental conditions are changed. However, the charge rising properties of the resultant toner tend to deteriorate. Therefore the addition quantity of a particulate titanium oxide is preferably smaller than that of a particulate silica, and in addition the total addition amount thereof is preferably from 0.3 to 1.5% by weight based on weight of the toner particles not to deteriorate the charge rising properties and to stably produce good images.

A method of preparing the toner of the present invention is explained, but is not limited thereto.

(1) Dispersing a colorant, an unmodified polyester, a polyester prepolymer having an isocyanate group and a wax in an organic solvent to prepare a toner constituents liquid.

The organic solvent is preferably volatile, having a boiling point less than 100° C. because of being easily removed after parent toner particles are formed. Specific examples of the organic solvent include toluene, xylene, benzene, carbon tetrachloride, methylenechloride, 1,2-dichloroethane, 1,1,2-trichloroethane, trichloroethylene, chloroform, monochlorobenzene, dichloroethylidene, methylacetate, ethylacetate, methyl ethyl ketone, methylisobutylketone, etc. These can be used alone or in combination. Particularly, aromatic solvents such as toluene and xylene and halogenated hydrocarbons such as methylenechloride, 1,2-dichloroethane, chloroform and carbon tetrachloride are preferably used. The toner constituents liquid preferably includes an organic solvent in an amount of from 0 to 300 parts by weight, more preferably from 0 to 100 parts by weight, and furthermore preferably from 25 to 70 parts by weight per 100 parts by weight of the prepolymer.

(2) Emulsifying the toner constituents liquid in an aqueous medium under the presence of a surfactant and a particulate resin. The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner constituents liquid preferably includes the aqueous medium is typically from 50 to 2,000 parts by weight, and preferably from 100 to 1,000 parts by weight. When less than 50 parts by weight, the toner constituents liquid is not well dispersed and toner particles having a predetermined particle diameter cannot be formed. When greater than 2,000 parts by weight, the production cost increases.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl(C4-C12) sulfonate and their metal salts, perfluorooctanesulfonic acid diethanol amides, N-propyl-N-(2-hydroxyethyl) perfluorooctanesulfone amide, perfluoroalkyl(C6-C10) sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

The particulate resin is included to stabilize a parent toner particles formed in the aqueous medium. Therefore, the particulate resin is preferably included so as to have a coverage of from 10 to 90% over a surface of the toner particle. Specific examples of the particulate resins include particulate polymethylmethacrylate having a particle diameter of 1 μm and 3 μm, particulate polystyrene having a particle diameter of 0.5 μm and 2 μm and a particulate polystyrene-acrylonitrile having a particle diameter of 1 μm. These are marketed as PB-200 from Kao Corporation, SGP from Soken Chemical & Engineering Co., Ltd., Technopolymer SB from Sekisui Plastics Co., Ltd., SGP-3G from Soken Chemical & Engineering Co., Ltd. and Micro Pearl from Sekisui Chemical Co., Ltd.

In addition, inorganic dispersants such as tricalcium phosphate, calcium carbonate, titanium oxide, colloidal silica and hydroxy apatite can also be used.

As dispersants which can be used in combination with the above-mentioned particulate resin and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

3) While an emulsion is prepared, amines (B) are included therein to be reacted with the polyester prepolymer (A) having an isocyanate group.

This reaction is accompanied by a crosslinking and/or a elongation of a molecular chain. The reaction time depends on reactivity of an isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

4) After the reaction is terminated, an organic solvent is removed from an emulsified dispersion (a reactant), which is washed and dried to form a parent toner particle.

The prepared emulsified dispersion (reactant) is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

5) A charge controlling agent is beat in the parent toner particle, and inorganic particulate materials such as particulate silica and particulate titanium oxide are externally added thereto to form a toner.

Known methods using a mixer, etc. are used to beat in the charge controlling agent and to externally add the inorganic particulate materials.

Thus, a toner having a small particle diameter and a sharp particle diameter distribution can be obtained. Further, the strong agitation in the process of removing the organic solvent can control the shape of a toner from a sphere to a rugby ball, and the surface morphology thereof from being smooth to a pickled plum.

Figure 11A:
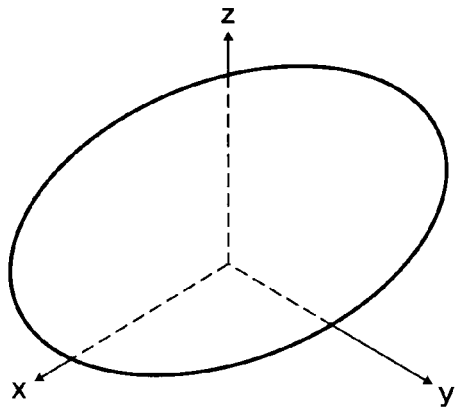
FIGS. 11A to 11C are schematic views for explaining a shape of the toner of the present invention.
Figure 11B:
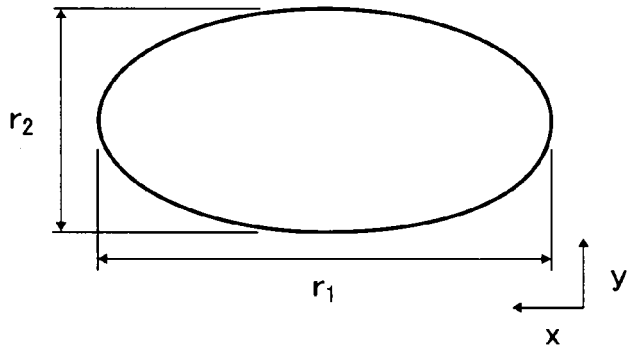
Figure 11C:
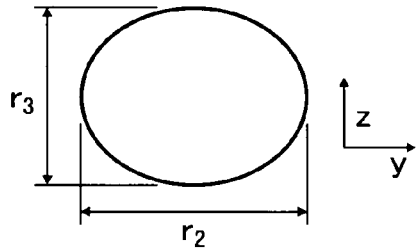

The toner for use in the present invention has the shape of almost a sphere, which can be specified as follows. FIG. 11A is an external view of the toner, and FIGS. 11B and 11C are cross sections of the toner, wherein the toner preferably satisfies the following relationship:

$$0.5 \leqq (r_2/r_1) \leqq 1.0 \text{ and } 0.7 \leqq (r_3/r_2) \leqq 1.0$$

wherein $r_1$, $r_2$ and $r_3$ represent the average major axis particle diameter, the average minor axis particle diameter and the average thickness of particles of the toner respectively, and wherein $r_3 \leqq r_2 \leqq r_1$.

When the ratio $(r_2/r_1)$ is too small, the toner has a form far away from the spherical form, and therefore the toner has poor dot reproducibility and transferability, resulting in deterioration of the image quality. When the ratio $(r_3/r_2)$ is too small, the toner has a form far away from the spherical form, and therefore the toner has poor transferability. When the ratio $(r_3/r_2)$ is 1.0, the toner has a form similar to the spherical form, and therefore the toner has good fluidity.

The above-mentioned size factors (i.e., $r_1$, $r_2$ and $r_3$) of toner particles can be determined as follows:

uniformly dispersing the toner on a smooth measuring surface;

observing 100 toners with a color laser microscope VK-8500 from Keyence Corp. at 500 magnifications to measure $r_1$, $r_2$ and $r_3$ thereof; and averaging them.

The toner prepared by polymerization methods has the shape of almost a sphere and a small particle diameter, but has lightly poor mixability and dispersibility with a developer in an image developer.

However, as shown in FIGS. 1 and 2, the image developer having three screws, i.e., the feeding screw 4, the collection screw 5 and the stirring transfer screw 6 which are functionally-independent largely improves the mixability and dispersibility of a toner having the shape of almost a sphere and a small particle diameter.

Further, the toner concentration sensor 15 detects the toner consumption, i.e., an amount of the toner required on a downstream side of the collection screw 5 to drive a toner feeder in real time. Therefore, the developer including even the toner prepared by polymerization methods, which is likely to be insufficiently mixed in the stirring transfer section 9 and the stirring transfer screw 6 has a stable toner concentration. As a result, the image developer produces images without uneven image density.

The present invention provides an image developer and an image forming apparatus capable of improving the dispersibility of a developer even including a toner having poor mixability and dispersibility, and precisely detecting the toner concentration to prevent uneven toner concentration of the developer and uneven image density. In addition, the image developer and image forming apparatus produce images without toner scattering or background fouling due to repeated excessive supplies of a toner, using a wide range of toners.

This is not only the case where the feeding screw is above the collection screw in FIG. 1, but also the case where the collection screw with a toner concentration sensor on a downstream side thereof is above the feeding screw.

The developer for use in the present invention is typically a two-component developer including a magnetic carrier and a non-magnetic toner. However, the developer is not limited thereto and other two-component developers, e.g., including a magnetic carrier and a magnetic toner can be used therein.

This application claims priority and contains subject matter related to Japanese Patent Application No. 2007-041737, filed on Feb. 22, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image developer, comprising:

a developer bearer configured to be rotatable facing an electrostatic latent image bearer;

a developer feeder configured to feed a developer comprising a toner to the developer bearer;

a developer collector configured to collect the developer separated and left from the developer bearer after the developer is fed to the electrostatic latent image bearer;

a detour route comprising a developer stirrer and transfer configured to stir and transfer the developer between the developer feeder and the developer collector;

a first opening configured to connect the developer feeder with the detour route;

a second opening configured to connect the detour route with the developer collector;

a developer supplier configured to supply the developer to the image developer;

a third opening configured to connect to the developer supplier; and a detector configured to detect a toner concentration of the developer, wherein the detector is located on a downstream side of the developer collector and on an upstream side of the second opening, wherein the toner has a volume-average particle diameter of from 3 to 8 μm and a ratio (Dv/Dn) of the volume-average particle diameter (Dv) to a number-average particle diameter (Dn) thereof of from 1.00 to 1.40.

2. The image developer of claim 1, wherein the toner has a shape factor SF-1 of from 100 to 180 and a shape factor SF-2 of from 100 to 180.

3. The image developer of claim 2, wherein the toner is prepared by a method comprising:

dispersing at least a polyester prepolymer having a functional group including a nitrogen atom, a polyester resin, a colorant and a release agent in an organic solvent to prepare a toner constituents solution; and crosslinking or elongating the toner constituents solution in an aqueous medium.

4. The image developer of claim 1, wherein the toner has the shape of almost a sphere.

5. The image developer of claim 1, wherein the toner satisfies the following relationship:

$$0.5 \leqq (r_2/r_1) \leqq 1.0 \text{ and } 0.7 \leqq (r_3/r_2) \leqq 1.0$$

wherein $r_1$, $r_2$ and $r_3$ represent the average major axis particle diameter, the average minor axis particle diameter and the average thickness of particles of the toner respectively, and wherein $r_3 \leqq r_2 \leqq r_1$.

6. The image developer of claim 1, wherein the third opening is located on a downstream side of the developer feeder or on an upstream side of the detour route.

7. The image developer of claim 1, wherein the first opening is located on an upstream side of the detour route and on a downstream side of the developer feeder.

8. The image developer of claim 1, wherein the developer bearer comprises a magnetic field generator comprising plural magnetic poles and a developer regulator configured to regulate an amount of the developer so as to be constant in the neighborhood of the surface of the developer bearer.

9. The image developer of claim 1, wherein the developer feeder is located at a slit between the developer regulator and the neighborhood of the surface of the developer bearer, and the developer collector is located at the slit.

10. The image developer of claim 1, wherein the developer feeder and the developer collector are spiral screws located in parallel with the developer bearer.

11. The image developer of claim 1, wherein the developer stirrer and transfer is a spiral screw located in parallel with the developer bearer.

12. The image developer of claim 1, wherein the developer is transferred in the same axial direction of the developer bearer at the developer feeder and the developer collector, and in the reverse direction at the developer stirrer and transfer in the detour route.

13. The image developer of claim 1, wherein a part of the image developer covering the developer stirrer and transfer in the detour route is so formed as to surround an outer circumference of the spiral screw.

14. The image developer of claim 1, wherein the developer is a two-component developer comprising a carrier and a toner.

15. An image forming apparatus, comprising:

an image bearer configured to bear an image;

an electrostatic latent image former configured to form an electrostatic latent image on the image bearer; and an image developer configured to develop the electrostatic latent image with a toner to form a visible toner image on the image bearer, wherein the image developer is the image developer according to claim 1.

* * * * *